United States Patent [19]

Scholz

[11] Patent Number: 4,932,885

[45] Date of Patent: Jun. 12, 1990

[54] HIGH DENSITY CONNECTOR

[75] Inventor: James P. Scholz, New Cumberland, Pa.

[73] Assignee: AMP Corporation, Harrisburg, Pa.

[21] Appl. No.: 374,195

[22] Filed: Jun. 29, 1989

[51] Int. Cl.[5] ..... H01R 9/09

[52] U.S. Cl. ..... 439/79; 439/60; 439/260; 439/630; 439/637

[58] Field of Search ..... 439/60, 79, 80, 83, 439/260, 630, 633, 634, 636, 637

[56] References Cited

U.S. PATENT DOCUMENTS

| | | | |
|---|---|---|---|
| 3,160,455 | 12/1964 | Mayon et al. | 439/60 |
| 3,660,803 | 5/1972 | Cooney | 439/637 |
| 4,095,866 | 6/1978 | Merrill | 439/60 |
| 4,298,237 | 11/1981 | Griffith et al. | 439/60 |
| 4,392,705 | 7/1983 | Andrews, Jr. et al. | 439/79 |
| 4,560,221 | 12/1985 | Olsson | 339/75 MP |
| 4,586,772 | 5/1986 | Cobaugh et al. | 339/75 MP |
| 4,613,193 | 9/1986 | Beers | 439/260 |
| 4,636,021 | 1/1987 | Bobb et al. | 339/75 MP |
| 4,659,155 | 4/1987 | Walkup et al. | 439/79 |
| 4,684,194 | 8/1987 | Jenkins et al. | 439/260 |
| 4,705,338 | 11/1987 | Sitzler | 439/630 |
| 4,806,103 | 2/1989 | Kniese et al. | 439/60 |
| 4,808,115 | 2/1989 | Norton et al. | 439/79 |

FOREIGN PATENT DOCUMENTS

| | | | |
|---|---|---|---|
| 1170256 | 11/1969 | United Kingdom | 439/637 |

*Primary Examiner*—Paula A. Bradley
*Attorney, Agent, or Firm*—Katherine A. Nelson

[57] ABSTRACT

A card edge connector 50 for electrically engaging a first and at least one other array of contact pads 46, 48 on a circuit board 40 comprises a first or inner subassembly 51 including housing member 52 having a first group of terminal members 20 disposed therein and a second or outer subassembly 71 including housing member 72 having at least one other group of terminal members 28 disposed therein. The first group of terminal members 20 is adapted to electrically engage the first array of contact pads 46 and the at least one other group of terminal members 28 is adapted to electrically engage the at least one other array of contact pads 48. The outer housing member 72 further including cavity means 86 adapted to receive the inner housing member 52 therein. In the preferred method of assembling connector 50, outer subassembly 71 is disposed over the inner subassembly 51 after the inner terminal members 20 have been electrically connected to their respective contact pads 46, typically by solder. The outer terminal members 28 are electrically connected to respective contact pads 48 after the connector 50 has been assembled. In the preferred embodiment each of the inner and outer housing members include two rows of terminal members 20, 28 respectively, the terminal members 20, 28 having opposed cantilevered beam contact sections 24, 32 respectively.

12 Claims, 5 Drawing Sheets

HIGH DENSITY CONNECTOR

FIELD OF THE INVENTION

This invention is related to the field of electrical connectors, and more particularly to connectors having multiple rows of contacts therein for engaging card edges.

BACKGROUND OF THE INVENTION

Card edge connectors typically contain contact elements having a first contact portion that either extends through the connector for insertion into another printed circuit board or is configured to mate with a terminal member in a complimentary connector and a second contact portion comprising a cantilever beam extending outwardly along a card receiving slot. The contact surface is located on the beam inwardly from the free end thereof and engages conductive traces on the printed circuit card. The convex surface on the beam provides a metal to metal mating area for good wiping action as the beam engages the card and for good electrical contact therewith. To enable high density interconnections, card edge connectors may also be provided with a plurality of rows of such cantilevered beams wherein an inner or first set of cantilevered beams extend outwardly a first distance along the card receiving slot and an outer or second set of cantilevered beams extend outwardly a second distance along the card receiving slot. Each set of cantilevered beams, therefore, can engage different contact pads on the surface of a circuit card inserted into the card receiving slot.

Typically this type of connector is made by first inserting the rows of contact elements that include the inner set of cantilevered beams into inner rows of terminal receiving passageways of a housing and then inserting the contact elements having the outer set of cantilevered beams into corresponding outer rows of terminal receiving passageways of the housing. Contact elements having essentially straight leads or pins for the first contact portion may be loaded into the housing from the card receiving edge, thus enabling the cantilevered beam to be formed prior to loading the contact element into the housing. Contact elements having a socket or a shape other than an essentially straight member for the first portion, however, are typically loaded from the opposite side or mating face of the housing. The latter approach requires that the cantilevered beam portions be formed after the contact elements have been loaded into the housing. To facilitate the forming process, the inner rows of contacts with their respective cantilevered beam portions are formed prior to loading of the outer rows of contact elements or terminal members into the housing. It is therefore necessary to provide means for preventing damage to the inner rows of terminals during the loading and forming of the outer rows of contact elements.

In addition to problems with loading the contact elements into the terminal housing, problems are also occur in trying to solder each one of the cantilevered beams to the appropriate locations on the inserted circuit board. The bulk of the cantilevered beams on the outside rows hinder the accessibility of the inner rows of beams during the soldering process, particularly if the contact elements are spaced closely together such as for example in what is termed in the art as high density connectors.

It is desirable therefore to have a means for making high density connectors that minimizes damage to other contact elements during the manufacturing process.

It is also desirable to have a cost effective means for making an electrical connector that requires a minimum of processing steps.

It is desirable therefore to have a means whereby double sets of cantilevered beams may be provided in a connector which may be soldered without interference from adjacent rows of cantilevered beams.

It is also desirable to have a method of assembling and forming the cantilevered beams wherein the previously formed beams are not subjected to damage during the forming of the subsequent pairs of cantilevered beams.

SUMMARY OF THE INVENTION

Accordingly, the present invention provides a means that alleviates the disadvantages and deficiencies of the prior art and furthermore provides a connector and method of making same that enables a user to readily solder the terminals of the connector in their desired locations. The present invention is directed to a card edge connector for electrically engaging a first and at least one other array of contact pads on a circuit board, the first array being at a first location on the circuit board and the at least one other array being at a second location spaced from the first location. The connector has a first and at least one other group of terminal members, each of the terminal groups being adapted to electrically engage one of the arrays of contact pads on the circuit board.

The connector comprises an inner subassembly including a dielectric housing member having the first group of terminal members disposed therein and an outer subassembly including a dielectric housing member having at least one other group of terminal members disposed therein. The first group of terminal members is adapted to electrically engage the first array of contact pads and the at least one other group of terminal members is adapted to electrically engage the at least one other array of contact pads. The outer housing member further includes cavity means adapted to receive the inner housing member therein. Means are also provided to retain the two subassemblies together. The connector is assembled by disposing the housing member of the inner subassembly into the cavity of the housing member of the outer subassembly.

In the preferred embodiment, the assembled connector has two inner rows and two outer rows of contact terminal members. Each group of terminal members comprises a plurality of pairs of terminal members, each pair having opposed cantilevered beam sections. In the preferred method of assembly, the circuit board having the arrays of contact pads thereon is inserted between the opposed cantilevered beams of the inner subassembly and the contact portions thereof are soldered to the first array of contact pads on the board. A tool is used to spread apart the pairs of cantilevered beams of the outer subassembly and the outer subassembly is positioned over the inner subassembly such that the inner housing member is received within the associated cavity of the outer housing member and the outer pairs of cantilevered beams are engaged with the other array of contact pads. The contact portions of the outer cantilevered beams are then soldered to the respective contact pads. It is to be understood that the invention is not limited to a four row connector. The same method can be used to provide for example a six or eight row connector having three or four separable housing portions and wherein each group of terminals is contained in a different housing member with each subsequent housing member including cavity portions for receiving the previous subassembly.

The present invention therefore is directed to a connector having at least two separable subassemblies wherein each subassembly comprises a housing member having a plurality of terminal receiving passageways therein for receiving a plurality of terminal members having contact elements, the forward end of the contact elements extending outwardly from the housing portions, the first or innermost housing subassembly being nestable within subsequent housing subassemblies whereby a connector having a plurality of pairs of extending contact members may be assembled subsequent to the forming of the extending contact members.

It is an object of the invention to provide a means whereby a plurality of sets of opposed cantilevered beam contact members may be provided in a connector wherein each inner set of beams may be soldered without interference from adjacent outer rows of cantilevered beams.

It is another object of the invention to have a method of assembling and forming the cantilevered beams wherein the previously formed beams are not subjected to damage during the forming of the subsequent pairs of cantilevered beams.

It is an object of the invention to provide a means for making high density connectors that minimizes damage to other contact elements during the manufacturing process.

It is also an object of the invention to have a cost effective means for making an electrical connector that requires a minimum of processing steps.

The invention itself, together with further objects and its intended advantages, will be best understood by reference to the following detailed description taken in conjunction with the following drawings.

BRIEF DESCRIPTION OF THE DRAWING

FIG. 8 is an end view of the inner subassembly having a circuit board mounted in the card receiving slot thereof and the outer subassembly in alignment for assembling the connector in accordance with the invention.

FIG. 9 is an end view of the assembled connector of FIG. 8.

DETAILED DESCRIPTION OF THE PREFERRED EMBODIMENT

Figure 1:
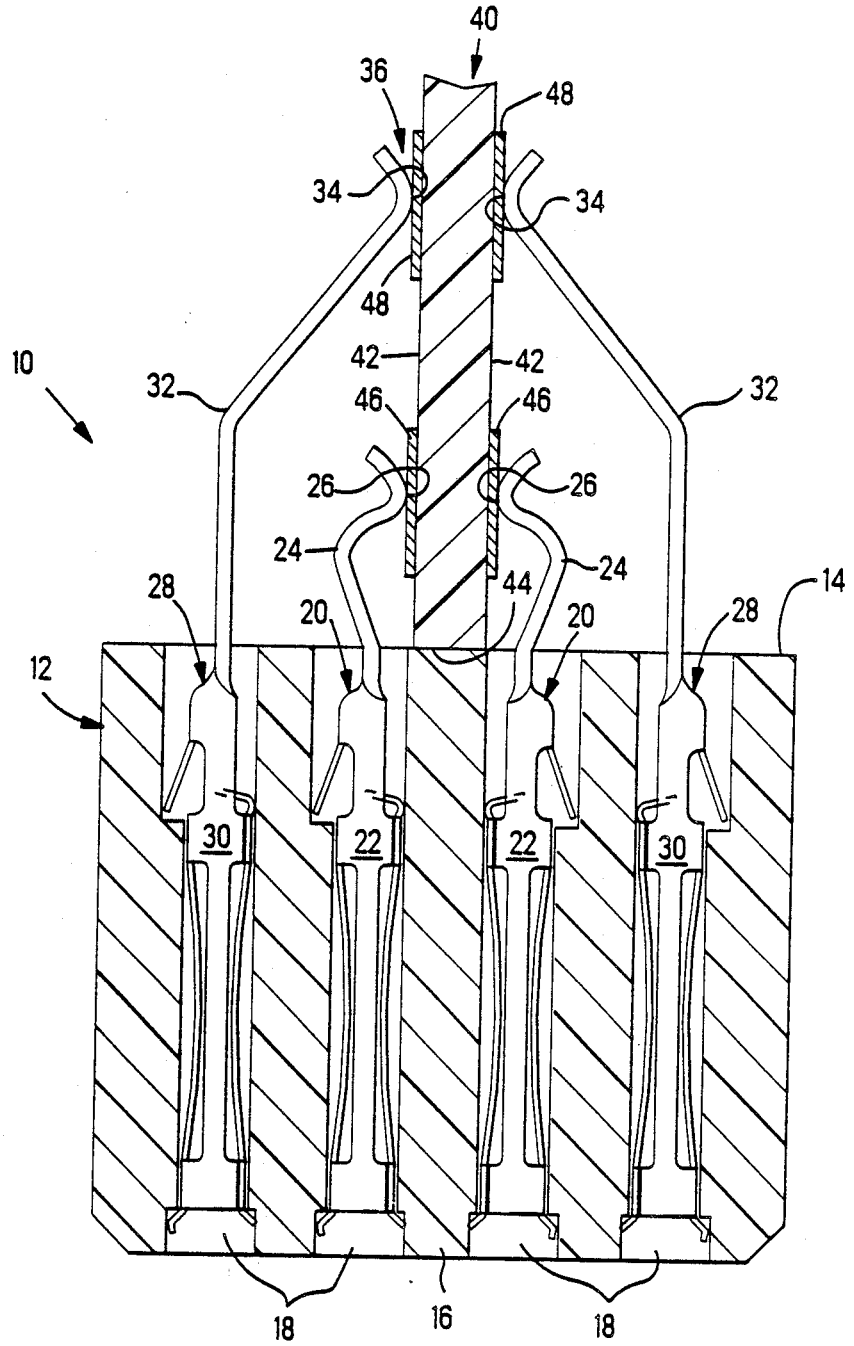
Fig. 1 PRIOR ART
FIG. 1 is a cross-sectional view of a connector of the prior art having a circuit board inserted in the card receiving slot with the terminal members mated to corresponding arrays of contact pads on a circuit board.

FIG. 1 illustrates prior art connector 10 comprising housing member 12, a plurality of first and second terminal members 20, 28 having cantilevered beam portions 24, 32 respectively extending outwardly from housing member 12 and defining a card receiving slot 36 therebetween. Housing member 12 has opposing front face 14 and mating face 16 and a plurality of terminal receiving passageways 18 extending therethrough arranged in four rows including two inner rows and two outer rows. Terminal members 20 are disposed in respective ones of terminal receiving passageways 18 of inner rows and terminal members 28 are disposed in respective ones of terminal receiving passageways 18 in outer rows. Terminal members 20 include first contact portions shown as a socket members 22 and second contact portions shown as cantilevered beam portions 24. Terminal members 28 include first contact portions shown as a socket members 30 and second contact portions shown as cantilevered beam portions 32.

The cantilevered beam portions 24, 32 define card receiving slot 36 in which circuit board 40 has been inserted. Circuit board 40 has opposed major surfaces 42 on which are disposed first and second arrays of contact pads 46, 48 respectively. First contact pads 46 are disposed on circuit board surface 42 proximate edge 44 of circuit board 40 and second contact pads 48 are disposed inward of edge 44. When circuit board 40 is fully inserted into slot 36, contact surfaces 26,34 of cantilevered beams 24,32 electrically engage respectively, of circuit board 40.

Figures 2, 3:
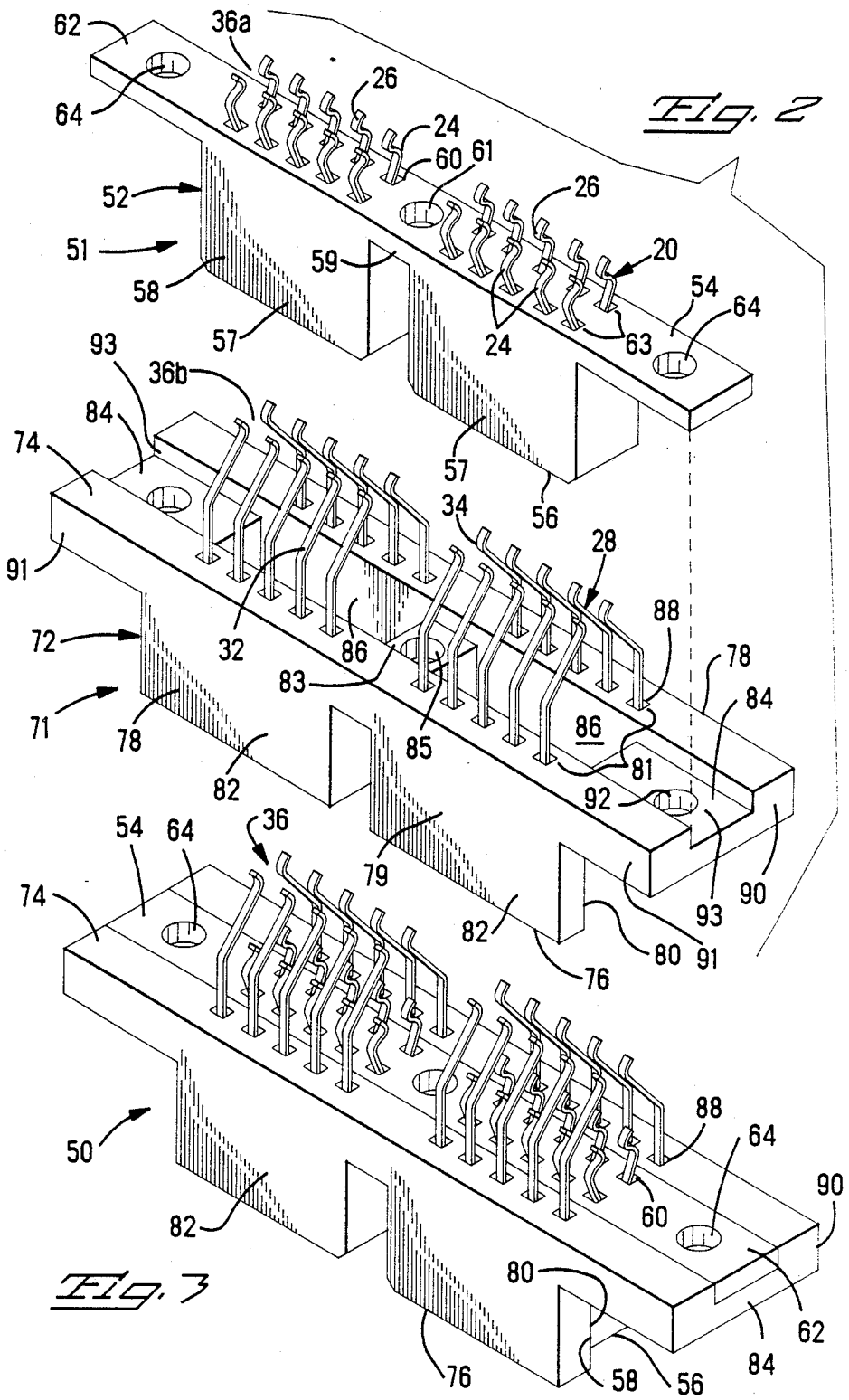
FIG. 2 is an exploded perspective view of the connector of the present invention.
FIG. 3 is an assembled perspective view of the connector of FIG. 2.
Figure 4:
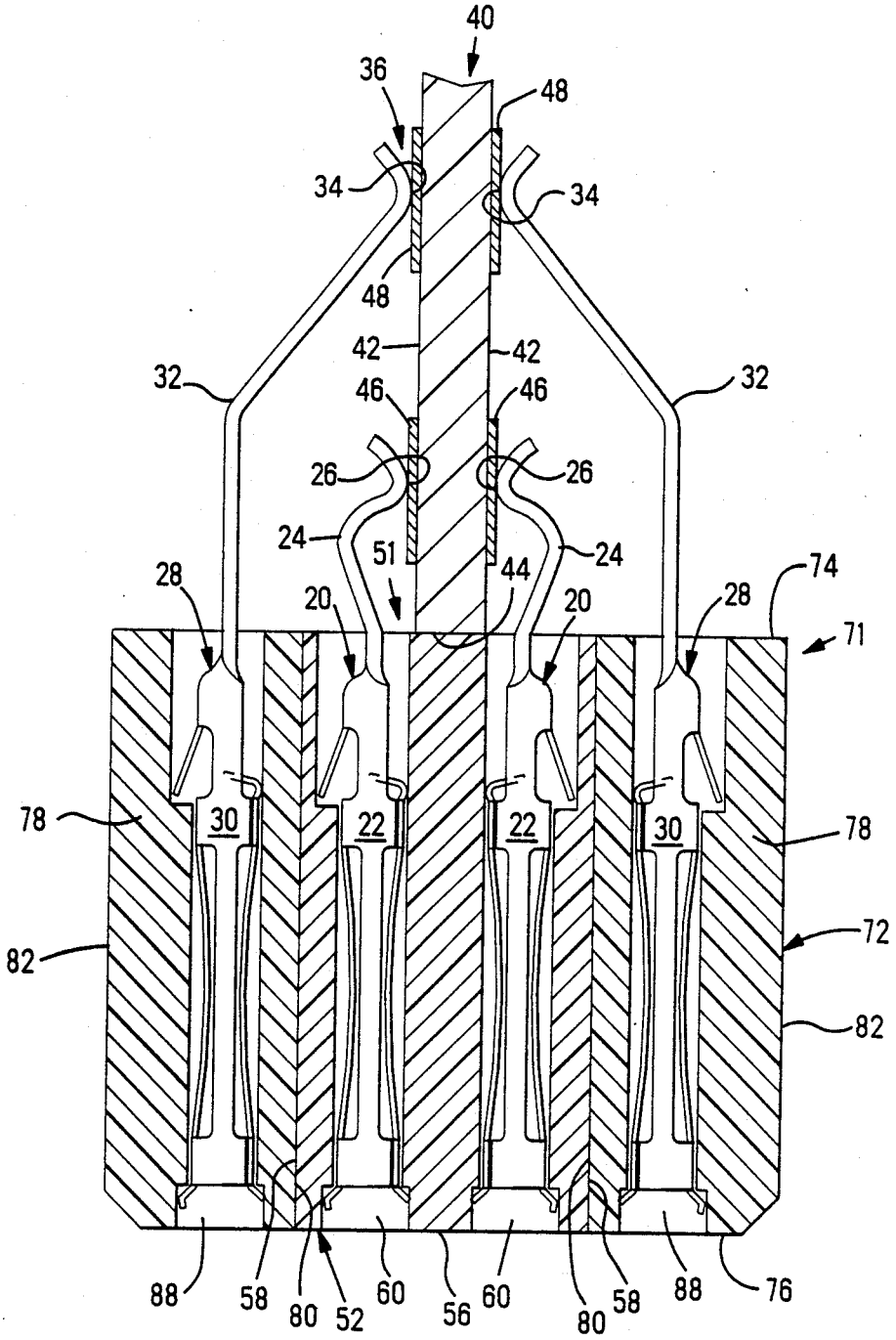
FIG. 4 is a cross-sectional view of the assembled connector of the present invention having a circuit board inserted in the card receiving slot with the terminal members mated to corresponding arrays of contact pads on a circuit board.

FIGS. 2, 3 and 4 show the construction of connector 50 in accordance with the present invention. For purposes of illustration, connector 50 will be shown with terminal members of the same type as shown in prior art connector 10. It is to be understood that the terminal members may have other configurations in addition to the ones shown. As can be seen in the exploded view of FIG. 2, connector 50 is comprised of first or inner subassembly 51 including housing member 52 having a plurality of terminal members 20 disposed therein and second or outer subassembly 71 including housing member 72 having a plurality of terminal members 28 disposed therein. Inner housing 52 has opposing front face 54 and mating face 56 and sides 58. As shown in these Figures, housing member 52 includes two body portions 57 joined by intermediate web 59 having aperture 61 extending therethrough. It is to be understood that the configuration of the housing members is representative only and that the number of body sections will depend primarily upon the desired length of the connector 50. Inner housing member 52 includes a plurality of terminal receiving passageways 60 extending therethrough arranged in two rows 63 in which are disposed terminal members 20. As better seen in cross-sectional view of FIG. 4, terminal members 20 include first contact portions shown as a socket members 22 and second contact portions shown as cantilevered beam portions 24. Cantilevered beam portions 24 define therebetween card receiving slot 36*a*. Inner housing member 52 further includes flange portions 62 having apertures 64 extending therethrough, which cooperate with corresponding means on second housing member 72 for securing connector 50 together.

Second housing member 72 has opposing front face 74 and mating face 76 and spaced apart side portions 78, which are joined by a plurality of web portions 84 and in the embodiment shown define two cavities 86 extending therebetween. Cavities 86 are adapted to receive therein a corresponding body section 57 of the first housing member 52. Each side portion 78 has respective inner sides 80 and outer sides 82. Outer housing member 72 has a plurality of terminal receiving passageways 88 extending therethrough arranged in two rows 81 in which are disposed terminal members 28. Terminal members 28 include first contact portions shown as a socket members 30 and second contact portions shown as cantilevered beam portions 32. Cantilevered beam portions 32 define card receiving slot **36*b* therebetween. Second housing member 72 further includes flanges 91, which in combination with webs 84 define elongated slot 93 extending longitudinally therealong for receiving a forward section of inner housing 52. Webs 84 include apertures 92 extending therethrough and are alignable with respective apertures 64 in flanges 62 for securing the first housing member 52 to the second housing member 72. As can also be seen in these Figures outer housing member 72 includes center web 83 having aperture 85 extending therethrough which cooperates with corresponding aperture 61 in web 59 in housing member 52**.

Figures 5, 6, 7:
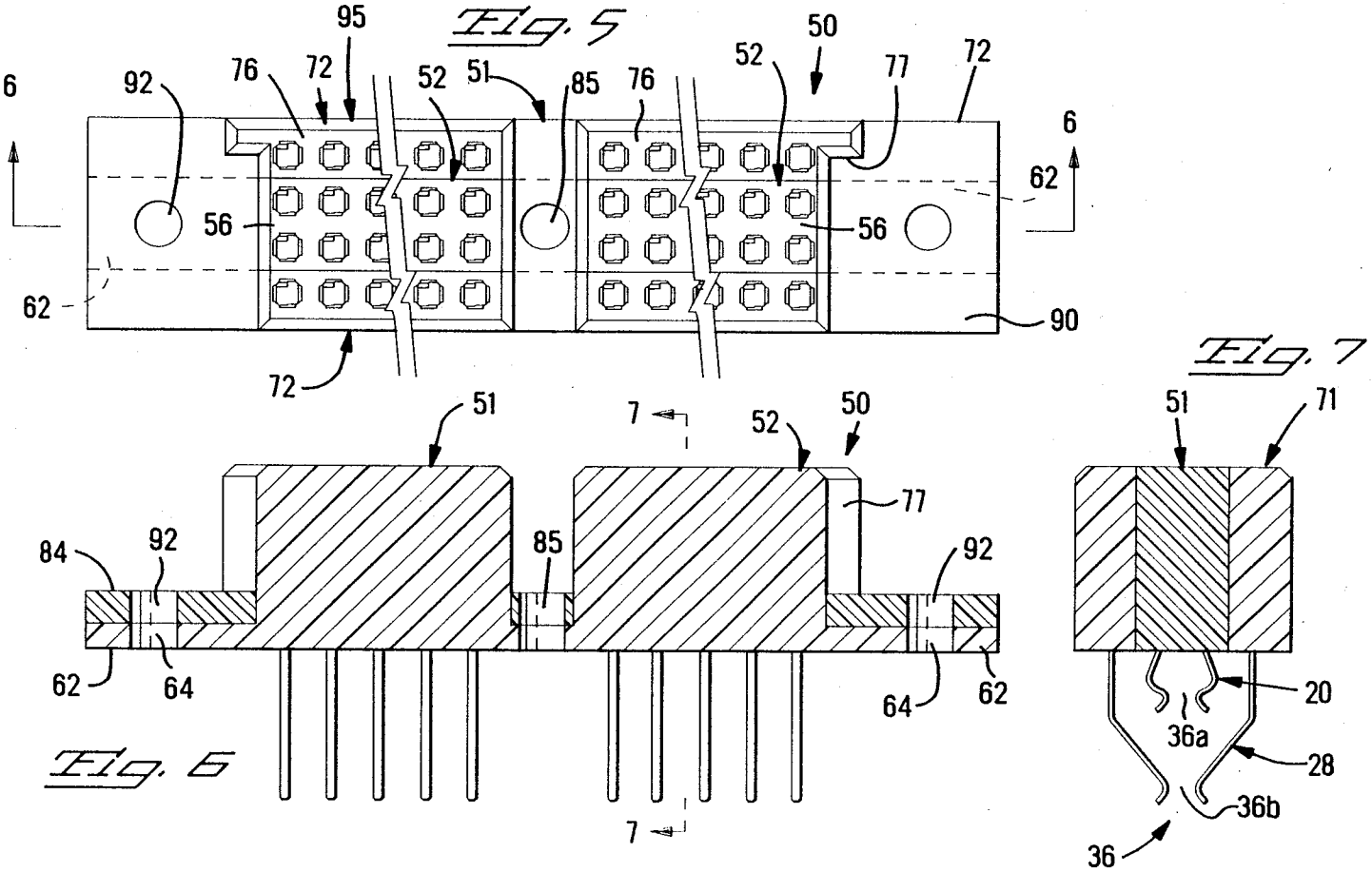
FIG. 5 is a top plan view of the present invention.
FIG. 6 is a longitudinal sectional view taken along line 6—6 of FIG. 5.
FIG. 7 is a cross-sectional view of the connector taken along line 7—7 of FIG. 6.

FIG. 3 shows a perspective view of the assembled connector in which the first subassembly 51 has been inserted into the inner housing receiving cavities 86 of second subassembly 71. The two housing members 52, 72 of subassemblies 51, 71, respectively are designed so that mounting means can be inserted through the corresponding flange and web portions to hold the assembled connector in alignment as best seen in FIG. 6. FIG. 5 is a top plan view of connector 50 illustrating one configuration of the mating face 95 comprising mating faces 56, 76 of inner and outer housing members 52, 72 respectively. Mating face 95 includes a polarizing feature as known in the art and indicated as 77.

The steps in making and using connector 50 are best understood by referring to FIGS. 8 and 9. As shown in FIG. 8, first subassembly 51 is made by inserting the terminal members 20 into terminal receiving passageways 60 of first dielectric housing member 52 and forming the second contact portions into cantilevered beam portions 24, thereby defining card receiving slot **36*a*. The second subassembly 71 is also made as a separate unit by inserting terminal members 28 into dielectric housing member 72 and forming the second contact portions into cantilevered beam portions 32, thereby defining card receiving slot 36*b* therebetween. By making connector 50 in two subassemblies 51, 71, the cantilevered beams 24 of first subassembly 51 can be soldered to a corresponding circuit pad array before the two subassemblies are joined together. To facilitate the soldering process and eliminate the problems associated with the prior art, a card is first disposed between the cantilevered beam portions 24 of the first subassembly 51 and the contact surfaces 26 of beams 24 are soldered to corresponding pads 46 on the circuit board 40. After that operation is complete the second subassembly 71 is disposed over the first subassembly 51 by using a tool to open the cantilevered beams 32 a sufficient distance to receive the first housing member 52 therebetween. After the two housing members 52, 72 have been assembled as shown in FIG. 9, the contact surfaces 34 of outer cantilevered beams 32 can be soldered to the corresponding circuit pads 48 circuit board 40**.

The present invention therefore provides a means whereby a customer can assemble a high density connector in a manner which facilitates soldering. Furthermore the outer rows of contact elements do not interfere with the soldering of the inner rows.

The present invention provides a means for making a high density card edge connector having an ease of assembly and ease of soldering to a card edge member. While the invention is shown with two rows of contacts it is also to be understood that additional outer housing members may also be added to the connector if subsequent rows of contacts are provided. The present invention therefore provides a means whereby a connector can in effect be expanded to have additional rows without the additional rows interfering with the manufacturing and forming of the inner rows or with the soldering of the inner rows.

It is thought that the connector of the present invention and many of its intended advantages will be understood from the foregoing description. Changes may be made in the form and construction and arrangement of parts thereof without departing from the spirit and scope of the invention or sacrificing all of its material advantages.

I claim:

1. A connector assembly for electrically engaging a first and at least one other array of contact means of an electrical article, said first array being at a first location on said electrical article and said at least one other array being at a second location spaced from said first array, said connector assembly comprising:

a first subassembly including a dielectric housing member having a first group of terminal members disposed therein, said first group of terminal members being adapted to electrically engage said first array of contact means;

at least one other subassembly including a dielectric housing member having at least one other group of terminal members disposed therein, said at least one other group of terminal members being adapted to electrically engage said at least one other array of contact means, said housing member of said at least one other subassembly further including cavity means adapted to receive said housing member of said first subassembly therein; and means for retaining said first subassembly and said at least one other subassembly together; whereby upon disposing said housing member of said first subassembly into said cavity means of said housing member of said at least one other subassembly, said electrical connector assembly is formed having a first and at least one other group of terminal members adapted to electrically engage a first and at least one other array of contact means on said electrical article.

2. The connector assembly of claim 1 wherein said first group of terminal members comprises a plurality of pairs of terminal members, each pair having opposed cantilevered beam contact sections.

3. The connector assembly of claim 1 wherein said at least one other group of terminal members comprises a plurality of pairs of terminal members, each pair having opposed cantilevered beam contact sections, said cantilevered beam contact sections of said at least one other group of terminal members being adapted to be sufficiently spread apart to receive said first subassembly therebetween during assembly of the connector.

4. The connector assembly of claim 1 wherein said connector assembly includes two subassemblies and two groups of terminal members.

5. The connector assembly of claim 1 wherein said electrical article is a circuit board and said first group and at least one other group of terminal members are adapted to electrically engage first and second arrays of contact pads on said circuit board.

6. The connector assembly of claim 5 wherein said first group of electrical terminal members is electrically engaged with and secured to corresponding ones of said first array of contact pads prior to assembling said first and second subassemblies.

7. A card edge connector for electrically engaging a first and at least one other array of contact pads on a circuit board, said first array being at a first location on said circuit board and said at least one other array spaced from said first array, said connector having a first and at least one other group of terminal members, each said terminal group being adapted to electrically engage one of said arrays of contact pads on said circuit board, said connector comprising:

an inner housing member having said first group of terminal members disposed therein, said first group of terminal members being adapted to electrically engage said first array of contact pads;

an outer housing member having at least one other group of terminal members disposed therein, said at least one other group of terminal members being adapted to electrically engage said at least one other array of contact pads, said outer housing member further including cavity means adapted to receive said inner housing therein; and means for retaining said inner housing member in said outer housing member; whereby upon disposing said inner housing member in said cavity means of said outer housing member said electrical connector is formed having a first and at least one other group of terminal members adapted to electrically engage a first and at least one other array of contact pads on a circuit board.

8. The connector of claim 7 wherein said first group of terminal members comprises a plurality of pairs of terminal members, each pair having opposed cantilevered beam contact sections.

9. The connector of claim 7 wherein said at least one other group of terminal members comprises a plurality of pairs of terminal members, each pair having opposed cantilevered beam contact sections, said cantilevered beam contact sections of said at least one other group of terminal members being adapted to be sufficiently spread apart to receive said inner housing member therebetween during assembly of the connector.

10. The connector of claim 7 wherein said first group of electrical terminal members is electrically engaged with and secured to corresponding ones of said first array of contact pads prior to assembling said first and second subassemblies.

11. A method of making a card edge connector for electrically engaging a first and at least one other array of contact pads on a circuit board, said first array being at a first location on the circuit board and said at least one other array being at a second location spaced from said first location, said connector having a first and at least one other group of terminal members, each said terminal group being adapted to electrically engage one of said arrays of contact pads on said circuit board, the method comprising the steps of:

providing a first housing member having a plurality of terminal receiving passageways extending therethrough;

selecting said first group of terminal members, said terminal members being adaptable to electrically engage said first array of contact pads;

disposing said first group of terminal members into respective ones of said passageways;

providing at least one outer housing member having a plurality of terminal receiving passageways extending therethrough said at least one outer housing member further including cavity means adapted to receive said first housing member therein; and disposing said first housing member in said cavity means of said at least one other outer housing member.

12. The method of claim 11 wherein said method further includes the step of electrically engaging said first group of terminals to said array of contact pads prior to disposing said first housing member into said cavity means of said at least one other housing member.

* * * * *